United States Patent [19]

Delmonte

[11] Patent Number: 4,954,815

[45] Date of Patent: Sep. 4, 1990

[54] HEAD POSITIONING SYSTEM

[76] Inventor: Jeffrey C. Delmonte, 553 Second St., Hermosa Beach, Calif. 90254

[21] Appl. No.: 208,368

[22] Filed: Jun. 17, 1988

[51] Int. Cl.[5] ..... G08B 21/00

[52] U.S. Cl. ..... 340/686; 272/DIG. 4; 200/DIG. 2; 128/782; 128/866; 128/76 R; 128/774

[58] Field of Search ..... 128/303 B, 782, 866, 128/876, 76 R, 70, 774, 759, 87 B, 97.1, 89 A; 340/686, 573, 825.19; 244/237; 379/52; 200/DIG. 2; 73/379-381; 272/125, 134, DIG. 4, 94

[56] References Cited

U.S. PATENT DOCUMENTS

| | | | |
|---|---|---|---|
| 3,205,303 | 9/1965 | Bradley | 358/250 |
| 3,779,549 | 12/1973 | MacNeil | 128/76 R |
| 4,153,244 | 5/1978 | Tauber, Jr. | 272/94 |
| 4,278,249 | 7/1981 | Forrest | 272/94 |
| 4,768,779 | 9/1988 | Oehman, Jr. et al. | 272/134 |
| 4,800,897 | 1/1989 | Nilsson | 128/782 |
| 4,845,987 | 7/1989 | Kenneth | 73/379 |

*Primary Examiner*—Joseph A. Orsino
*Assistant Examiner*—Jill Jackson
*Attorney, Agent, or Firm*—T. E. Kristofferson; Richard S. Koppel

[57] ABSTRACT

A head positioning system including contact means placing the head in a controlled position which includes means for allowing controlled repeatable motion about at least one of three mutually perpendicular axes. Translational means along each axis and transducer means about each axis and on each of the translational means may also be provided.

12 Claims, 4 Drawing Sheets

HEAD POSITIONING SYSTEM

BACKGROUND OF THE INVENTION

The background of the invention will be discussed in two parts.

1. Field of the Invention

This invention relates to head positioning systems and more particularly to such systems in which a person's head is placed on contact means in a controlled position while allowing controlled repeatable motion around at least one of three mutually perpendicular axes.

2. Description of the Prior Art

In the prior art, systems have been proposed for allowing a person who is largely disabled to use head motion to control the operation of a device such as a wheelchair. See, for example, U.S. Pat. No. 3,374,845 Selwyn or U.S. Pat. No. 4,078,627 Brown, et al. The inventions of these two patents do not support the head or maintain it in a controlled position but rather are more for the type of individual who still maintains normal head control.

U.S. Pat. No. 2,855,202 Kinne discloses a neck exercising device which takes the weight off the neck by means of a cable 27 and allows rotation of the head at least about two mutually perpendicular axes plus limited motion about an additional non-perpendicular axis in order to exercise the neck. It is pointed out that this patent does not place the head in a controlled position around which rotation may take place.

U.S. Pat. No. 4,093,037 Miller III discloses a wheelchair control headrest. The head fits against a cup means. However, it is not placed in a controlled position in the manner of the present invention.

U.S. Pat. Nos. 4,486,630 Fetchko, 4,682,159 Davison and 4,688,037 Krieg all disclose inventions in which the head motion is used to control a device. However, none of these place the head in a controlled position in the manner of the subject invention nor is there any head support.

U.S. Pat. Nos. 3,156,239 Uribe M., 3,336,922 Taylor and 3,605,736 D'Amico, et al. all disclose traction helmets or devices which are designed to maintain the head in a fixed position. U.S. Pat. No. 2,791,999 Bustamante discloses a neck exercising device used to tension or stretch the neck muscles and U.S. Pat. Nos. 2,638,293 Lindstrom and 3,170,659 Wood Jr. disclose head restraining devices for use in space vehicles or by pilots which are not devices providing positioning means for placing the head in a controlled position and providing pivot means in the manner of the subject invention.

It is accordingly an object of the present invention to provide a head positioning system which includes positioning means placing the head in a controlled position. Pivot means are provided connected to the positioning means for allowing motion around at least one of three mutually perpendicular axes.

SUMMARY OF THE INVENTION

The foregoing and other objects are accomplished by providing a head positioning system which includes means for placing the head in a controlled position. Motion is allowed about at least one of three mutually perpendicular axes by pivot means connected to the positioning means.

In alternative embodiments translation means may also be provided along the x, y or z axis. In another alternative embodiment transducer means may be mounted on the pivot means or translation means for generating a signal proportional to the motion of the pivot or translation means relative to the positioning means which may be used as a control or indicating signal.

In still further embodiments means may be used for immobilizing motion around at least one of the three mutually perpendicular axes and stop means may be used for limiting motion around any of the three axes.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
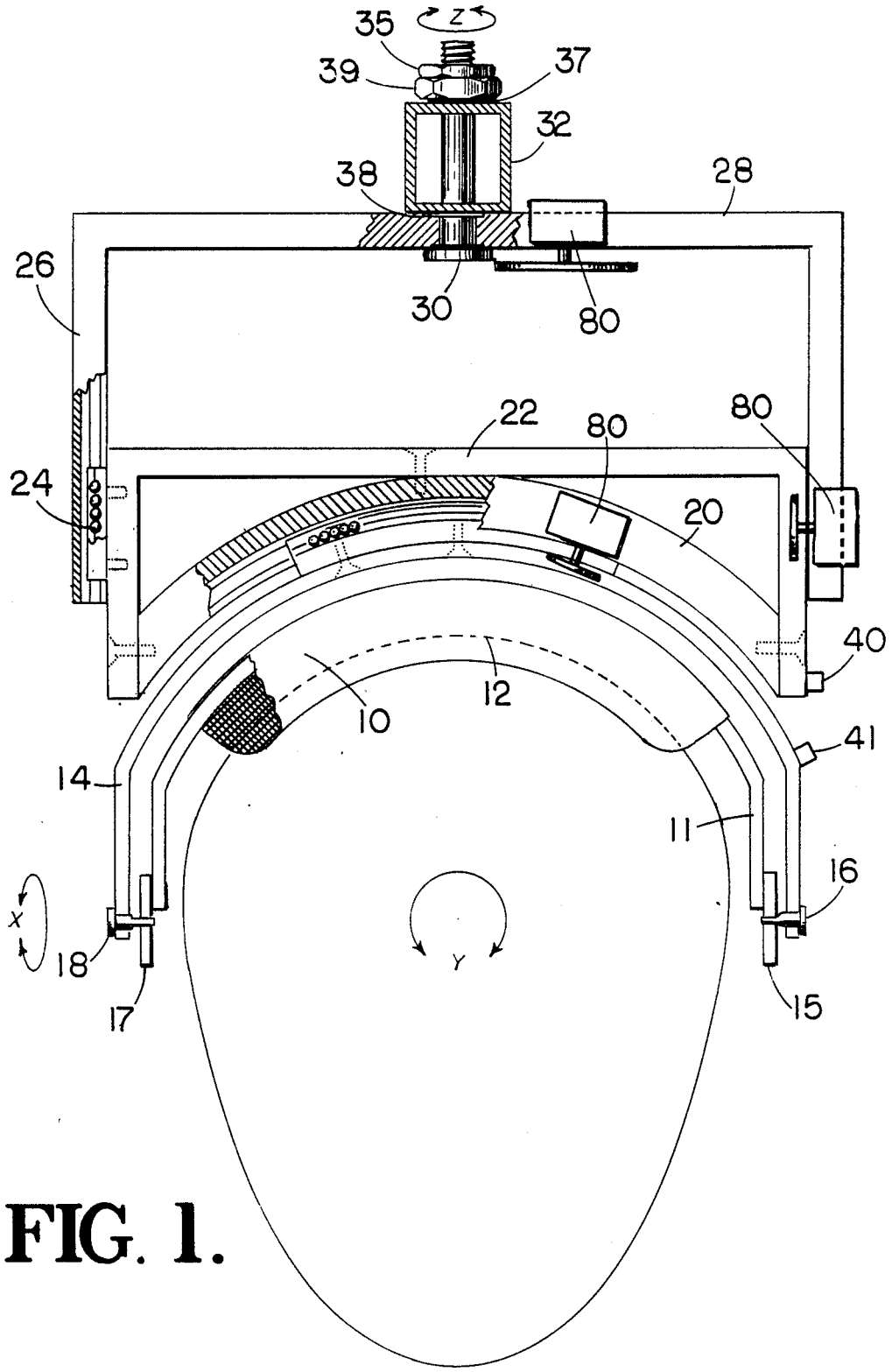
FIG. 1 is a top view of a portion of the head positioning system illustrating the rotatability about the three mutually perpendicular axes.
Figure 2:
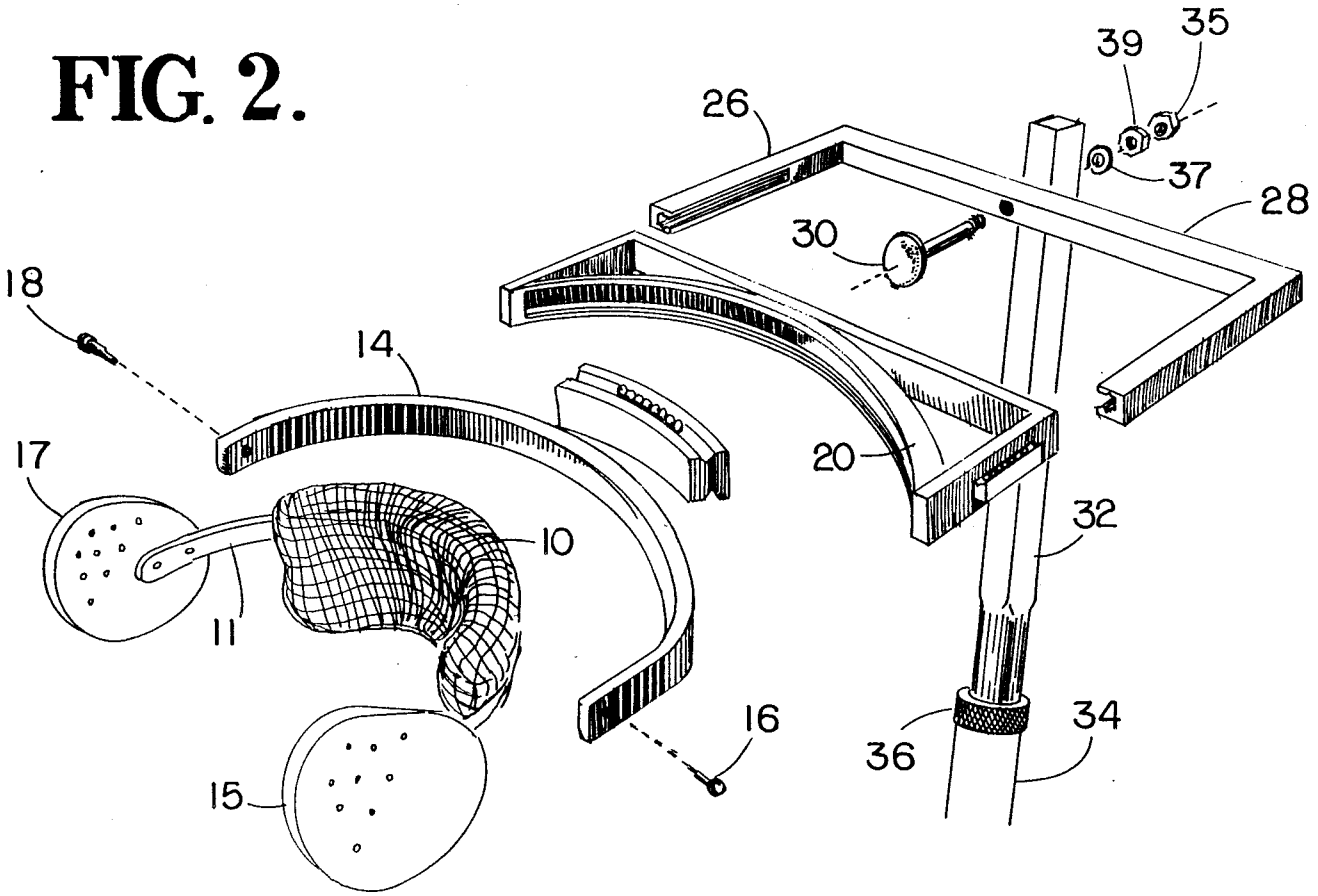
FIG. 2 is an exploded perspective view of the head positioning system.

FIGS. 1 and 2 illustrate a head positioning design entitled The Lean Back Version. An occipital pad 10 and its support structure 11 engages the occipital plate of the head 12 and thus supports some of its weight. From the headrest are extended adjustable shaped sector plates 15 and 17 that provide a pivotal areas near the right and left ears of the user respectfully. With the user seated in a reclining position and with the head supported by the head rest the invention is designed to pivot around the x axis once the sector plates are suitably adjusted to engage horizontal pivots 16 and 18 which extend from the arcuate movable structure 14 and also extends symmetrically to each ear area. The structure 14 extends behind the head of the user and is designed to move in an arc with the head motion about the y axis which is into the page in FIG. 1 and substantially off vertical on the FIG. 2. An outer curved track 20 supports the inner rotating partial circle structure 14 allowing for y axis rotation. The curved track 20 can also be a curve other than a circle. At the ends of the rotating inner partial circle structure are the pivot points 16 and 18 allowing for the fitted surface that supports the head to rotate about the x axis. Thus, the head and head rest can move easily as a two axis rotational system. A third axis of rotation is configured into the track support 20 to enable the head and head rest to move about the z axis. In FIG. 1 a bar 22 is attached to the back of the track support 20 and contains at its extremity, a linear glide 24 which moves within element 26 to allow for translation motion of the head rest along the z axis. The right angle extension 28 of element 26 rotates around a pivot point 30 for permitting rotation around the z axis while a telescoping square ended tube 32 provides up and down planar linear motion parallel to the y axis within slotted tube 34 for initial positioning of the head after which nut 36 is tightened to fix the head positioning system in place.

In the embodiment of FIG. 2 rotation around the z axis is provided by pivot point 30 attached to element 26 extension 28 which engages height adjusted square ended tube 32. Tension between these three elements is controlled by locking nuts 35, 39 and washer 37, 38.

The lean back head positioning system is comfortable and is adjustable to the user's requirements of head and body positioning and motion including adjustable amounts of head support and may include stops 40, 41 and dampening. It offers no obstruction to the eyes and jaw movement of the user and offers partial to full head weight support depending upon the reclining position selected. Contact of the user's head is also possible without head support. The user could use this system while lying flat on his back. It offers ease of access, comfort, safety, and has no release restraints. It emphasizes head mobility and tracking of the head about three mutually perpendicular axes. The lean back head rest system can be rotated so that the user is in an upright position. Persons that require additional head support can use off the shelf devices such as helmets, half helmets, head bands, chin support, cervical collars, etc. which can be made attachable to a modified headrest thus capturing the head securely yet permitting maximum rotational motion of the head. It is pointed out that the head rest system is not a cervical traction device, a total immobilization device, an orthopedic traction device, an exercising device or a head restraint for use for example, in aircraft.

Figure 3B:
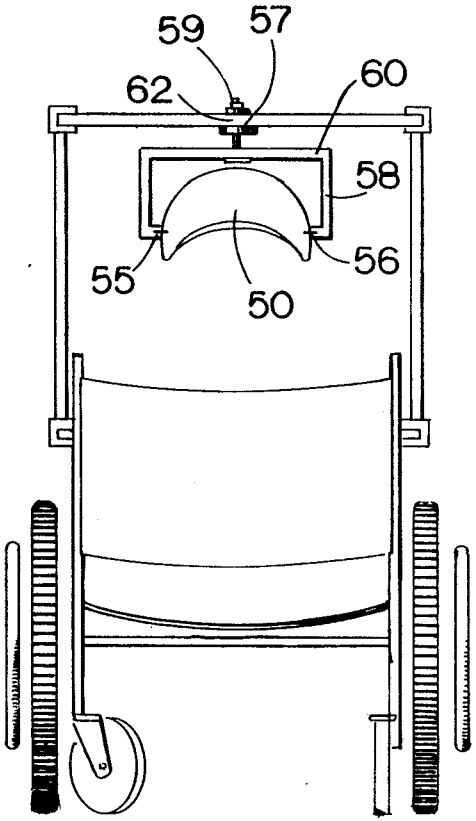
FIGS. 3*a* and *b* show a side and front view respectively of a head positioning system mounted on a wheelchair.
Figure 3A:
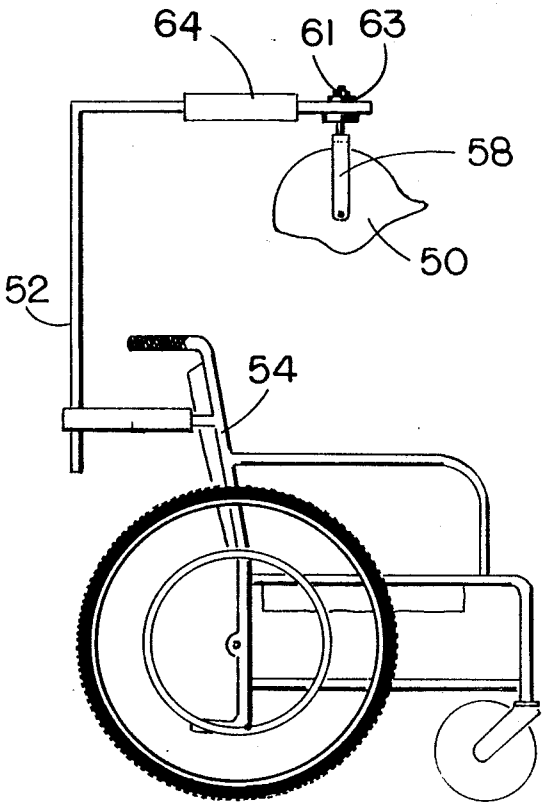

In FIG. 3 in a second embodiment, a fitted helmet 50 is adjusted to and supports the head when the head is in normal upright balance position. The height of the helmet is controlled and adjusted by a vertical support bar 52 extending from either a fixed or a mobile structure such as a wheelchair 54. The helmet is designed to pivot with the head about the x axis on pivots 55 and 56. The pivot support structure 58 extends upward and across the top of the helmet at 60 and engages a thrust bearing plate 57 and pin 59 at its center 62 which in turn permits the head and helmet to turn about the y axis. Both helmet and head are thus supported and tied into a two axis rotational system. Pin 59 is secured with locknut 61 and washer 63. Body motion forward and backward may also be accommodated by a slide bearing 64. Support and controlled mobility of the head motions are greatly enhanced by this helmet head positioning system.

Figure 4:
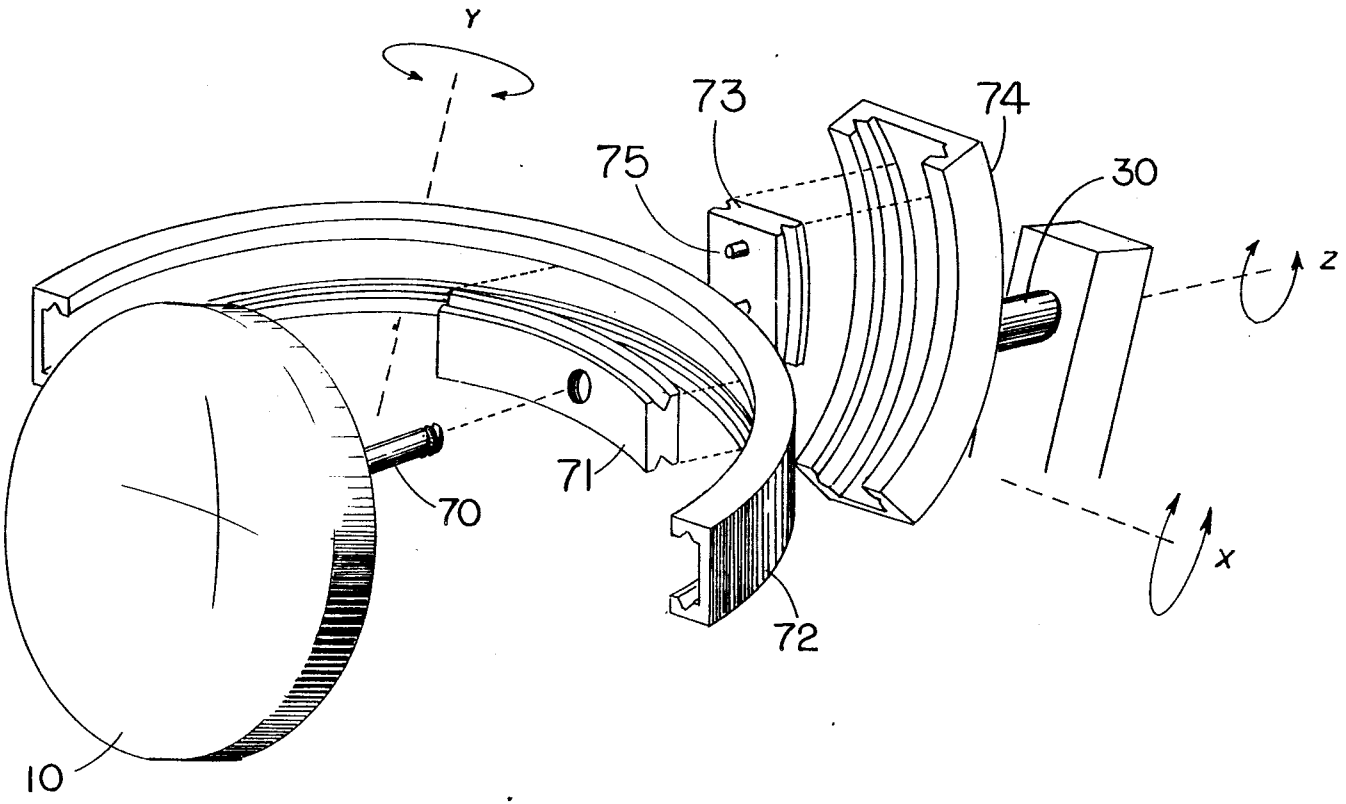
FIG. 4 is an exploded perspective view of the head positioning system with x and y axes arcuate head control structures joined.

A third head positioning system, FIG. 4 also utilizes parts of previous disclosed designs. Here 10, by connection means 70, engages the center of arcuate moving member 71. The latter being guided about the y-axis of head rotation by partial outer ring track 72. Head motion about the x-axis is accomplished by connection means 75 which joins the centers of a second arcuate moving structure 73 to 72. Arcuate moving structure 73 is guided to move at right angles to 72 by partially circular (or lobe) track 74. Thus the headrest can move about the x and y axes of head motion.

Spatial support follows that described in FIGS. 1 and 2 utilizing a pin 30 means and telescoping tubular support means to a fixed or mobile structure.

An alternate head positioning system can utilize parts of the previously disclosed designs supported by means such as a body harness which is worn by the user making it a more portable system.

In all cases the head positioning system offers controlled head mobility tracking and support from desired or selectable body positions. The system prevents flopping of the head from side to side while allowing smooth, easy, repeatable motion. Enhanced communicative and control skill and ability are made possible for the user with the use of sensor pick-offs 80 at the various axes pivot points and translation lines. The sensor signals can be converted to adapt to and control electronic devices such as matrix boards, switches, keyboards, CRT cursor position and scanning selection, games, toys, remote control devices, etc.

Thus, the head positioning provides a positioning device that allows support and tracking and control of head motion. It also permits its usage as an adaptive communication device for controlled enhancement beyond the use of two hands, for example. It also provides a supportive device useful for medical repairs to the head, neck, and spine for injuries which may be temporary or permanent in nature. The head positioning system is also designed for use by a passenger or driver engaged in transportation activities and may also be used in conjunction with the design of specialized chairs or seats, such as dental, doctor's operation seats, lounge, etc.

Since the principles of the invention have now been made clear, modifications which are particularly adapted for specific situations without parting from those principles will be apparent to those skilled in the art. The appended claims are intended to cover such modifications as well as the subject matter described and to be limited only by the true spirit of the invention.

I claim:

1. A head positioning system for physically impaired persons including positioning means having x, y and z axes for placing the head in a controlled position which provides support for the head including means for preventing uncontrolled motion transitional of the head with respect to said system along the x axis and along the y and z axes after adjustment along the y and z axes, x axis pivot means connected to said positioning means for allowing enhanced, free flowing, non-resistive motion about said x axis.

2. The head positioning means of claim 1 including stop means for limiting motion around said x axis.

3. The head positioning system of claim 1 including y axis pivot means connected to said x axis pivot means for allowing enhanced free flowing, non-resistive motion about said y axis perpendicular to said x axis.

4. The head positioning system of claim 3 including translational means connected to the positioning means for translation along the y axis while said means for preventing uncontrolled linear translational motion in the y axis is temporarily disabled in order to perform said adjustments.

5. The head positioning system of claim 3 including means for immobilizing motion around one of said x or y axis.

6. The head positioning means of claim 3, including stop means for limiting motion around at least one of said x and y axes.

7. The head positioning system of claim 3 including z axis pivot means connected between said positioning means and said y axis pivot means for allowing enhanced, free flowing, non-resistive motion about said z axis perpendicular to said x axis and y axis.

8. The head positioning system of claim 3 including transducer means mounted to measure motion about at least one of said x, y or z axis pivot means for generating a signal proportional to the motion of the pivot means relative to the positioning means which may be used as a control or indicating signal.

9. The head positioning system of claim 7 including means for immobilizing motion around one or two of said x, y or z axes.

10. The head positioning means of claim 7 including stop means for limiting motion around at least one of said x, y or z axes.

11. The head positioning system of claim 7 including translational means connected to the positioning means for translation along the z axis while said means for preventing uncontrolled linear translational motion in the z axis is temporarily disabled in order to perform said adjustments.

12. The head positioning system of claim 11 including transducer means mounted to measure motion along said translational means.

* * * * *